US005287668A

United States Patent [19]

Dall et al.

[11] Patent Number: 5,287,668

[45] Date of Patent: Feb. 22, 1994

[54] APPARATUS AND METHOD FOR REFURBISHING A CEILING GRID TO PERMIT INSTALLATION OF CEILING PANELS

[75] Inventors: David L. Dall, Marietta, Ga.; Jeff Limp, Naperville, Ill.

[73] Assignee: Capaul Corporation, Plainfield, Ill.

[21] Appl. No.: 913,849

[22] Filed: Jul. 15, 1992

[51] Int. Cl.[5] ..... E04B 9/00

[52] U.S. Cl. ..... 52/488; 52/28; 52/484; 52/730.6

[58] Field of Search ..... 52/488, 28, 730.6, 484

[56] References Cited

U.S. PATENT DOCUMENTS

| | | | |
|---|---|---|---|
| 2,926,237 | 2/1960 | Sorenson | 52/484 X |
| 2,978,571 | 4/1961 | Rosenblatt | 52/484 X |
| 2,981,386 | 4/1961 | Reske et al. | 52/484 X |
| 3,037,594 | 6/1962 | Kaufman | 52/484 X |
| 3,343,310 | 9/1967 | Netz et al. | 52/489 X |
| 3,546,842 | 12/1970 | Blum | 52/484 X |
| 3,685,235 | 8/1972 | Lang | 52/488 X |
| 4,186,537 | 2/1980 | Mountz | 52/488 X |
| 4,944,129 | 7/1990 | Hartleif | 52/488 X |
| 4,986,050 | 1/1991 | Brunetti | 52/488 |
| 4,991,370 | 2/1991 | Gailey | 52/488 X |
| 5,077,951 | 1/1992 | Baker | 52/488 X |
| 5,203,818 | 4/1993 | Kuiper | 52/488 X |
| 5,215,284 | 6/1993 | Hungerford | 52/488 X |
| 5,226,720 | 7/1993 | Caferro | 52/484 X |

*Primary Examiner*—Carl D. Friedman
*Assistant Examiner*—Beth Aubrey
*Attorney, Agent, or Firm*—Wallenstein, Wagner & Hattis, Ltd.

[57] ABSTRACT

The present invention relates to a method of installing asbestos impermeable acoustical ceiling panels to an existing suspended ceiling system, and a bracket and asbestos impermeable ceiling panel therefor. This method utilizes existing light fixture supports so that existing light fixtures and any asbestos insulation need not be removed. The method generally comprises the following steps: a) providing a plurality of brackets having base and tee portions, a leg extending from the base, and a flange extending from the tee, b) aligning each bracket so that its flange engages the lips of the existing light fixtures, c) attaching the legs to the existing light fixture supports, and d) mounting the new ceiling panels on the tee portions of the brackets. The ceiling panel comprises a layer of acoustical material with an asbestos impermeable vinyl backing secured to its upper surface and an asbestos impermeable coating applied to its edges. Asbestos particles accumulating on the upper surface of the ceiling panel are easily vacuumed away.

12 Claims, 4 Drawing Sheets

APPARATUS AND METHOD FOR REFURBISHING A CEILING GRID TO PERMIT INSTALLATION OF CEILING PANELS

DESCRIPTION

1. Technical Field

The present invention generally relates to a method of installing ceiling panels to an existing suspended ceiling system without removing existing light fixtures or disturbing existing asbestos insulation, and a novel bracket and asbestos impermeable, acoustic ceiling panel therefor.

2. Background Prior Art

Modern commercial buildings are typically equipped with suspended grid supported ceiling systems. These ceiling systems conceal electrical conduit, air ducts and fire protection systems hung from a concrete ceiling/-floor slab. In older buildings, asbestos was sprayed on the structure for fire protection.

FIG. 1 shows a portion of a typical suspended ceiling system comprised of light fixtures 10, acoustic ceiling panels 20 and supports 30. Each light is equipped with an adjustable lug 12 that spans a pair of supports 30. These supports 30 usually comprise angle iron suspended from wire 32 that is anchored to a metal or concrete structure (not shown). Support angle 30 is typically L-shaped to form a ledge 34 that supports the edge of ceiling panel 20. Support 30 can also be U-shaped or have an additional H, Z or T shaped member attached thereto. Light fixture lugs 12 are provided with screws 14 for adjusting the height of the fixtures. Screws 14 enable the bottom surface 22 of ceiling panel 20 to be flushed out with a lower lip 16 of the light fixture 10. A well known manufacturer of such ceiling systems was Soundlock Corporation of 2004 Breckenridge Drive N.E., Atlanta, Ga. 30345.

As noted above, in older buildings, a layer of asbestos insulation is often applied to the underside of the ceiling slab for fire protection purposes. This asbestos layer covers the underside of the slab and generally is applied after all necessary supports are anchored to the ceiling slab. The installation of new light fixtures or a new grid for the ceiling panel supports requires the removal of the asbestos layer.

Replacement or renovation of suspended ceilings is quite costly for buildings with asbestos insulation. Asbestos is carcinogenic and its removal is both time consuming and costly. Safety codes such as those provided by OSHA only allow workers to be exposed to a prescribed amount or area of asbestos at any given time. Therefore, large areas of floor space must be closed off for long periods of time during the removal process.

Ceiling panel replacement costs are further increased because existing light fixtures cannot be utilized. One reason for this is that extremely tight tolerances would have to be maintained during the manufacture of the ceiling panel in order to ensure proper fit and alignment with existing light fixtures. Another reason is that the old fixtures would be unsightly if left in place. The edges of these fixtures are generally worn, bent or rusted from years of use and the installation of new panels does not resolve this problem. New panels remain flush with the bottom surface of the lights and do not cover up the edges.

An additional problem associated with conventional suspended ceilings is that, over time, carcinogenic asbestos particles fall from the ceiling slab and accumulate on and penetrate the panels. This contaminates the panels and increases the likelihood that persons working in or occupying the building will be exposed to asbestos.

The present invention is provided to solve these and other problems.

SUMMARY OF THE INVENTION

The present invention relates to a method of installing ceiling panels to an existing suspended ceiling system, and a bracket and asbestos impermeable, acoustic ceiling panel therefor. This method utilizes existing light fixture supports so that existing light fixtures and asbestos insulation need not be disturbed or removed. The method generally comprises the following steps: a) providing a plurality of brackets having base and tee portions, a leg extending from the base, and a flange extending from the tee, b) aligning each bracket so that its flange engages the lips of the existing light fixtures, c) attaching the legs to the existing light fixture supports, and d) mounting the new ceiling panels on the tee portions of the brackets. The ceiling panel comprises a layer of acoustical material such as fiber glass with an asbestos impermeable vinyl backing secured to its upper surface and an asbestos impermeable coating applied to its edges.

One advantage of the present invention is that new ceiling panels may be installed without disturbing any existing asbestos layer applied to the underside of the ceiling slab. This feature greatly reduces the cost of installing new ceiling panels or replacing existing panels with acoustical panels.

Another advantage of the present invention is that carcinogenic asbestos particles are trapped on the upper surface of the ceiling panels and can be vacuumed away when necessary. This reduces the possibility of workers coming in contact with the asbestos particles and improves the conditions for persons residing or working in the building.

A further advantage of the present invention is that the cost of the new ceiling is reduced because existing light fixtures and supports do not have to be removed or replaced.

An even further advantage of the present invention is that the worn edges of the existing light fixtures are covered. Flanged brackets are secured to the supports so that its flange lays smoothly against and covers the worn edge of the light fixture.

A still further advantage of the present invention is that it provides installation flexibility that permits manufacturing tolerances of the new ceiling panels to be reduced. This greatly reduces the cost of the individual ceiling panels and the overall cost of the new dropped ceiling.

Other features and advantages of the invention will be apparent from the following specification taken in conjunction with the following drawing.

DETAILED DESCRIPTION

Figure 1:
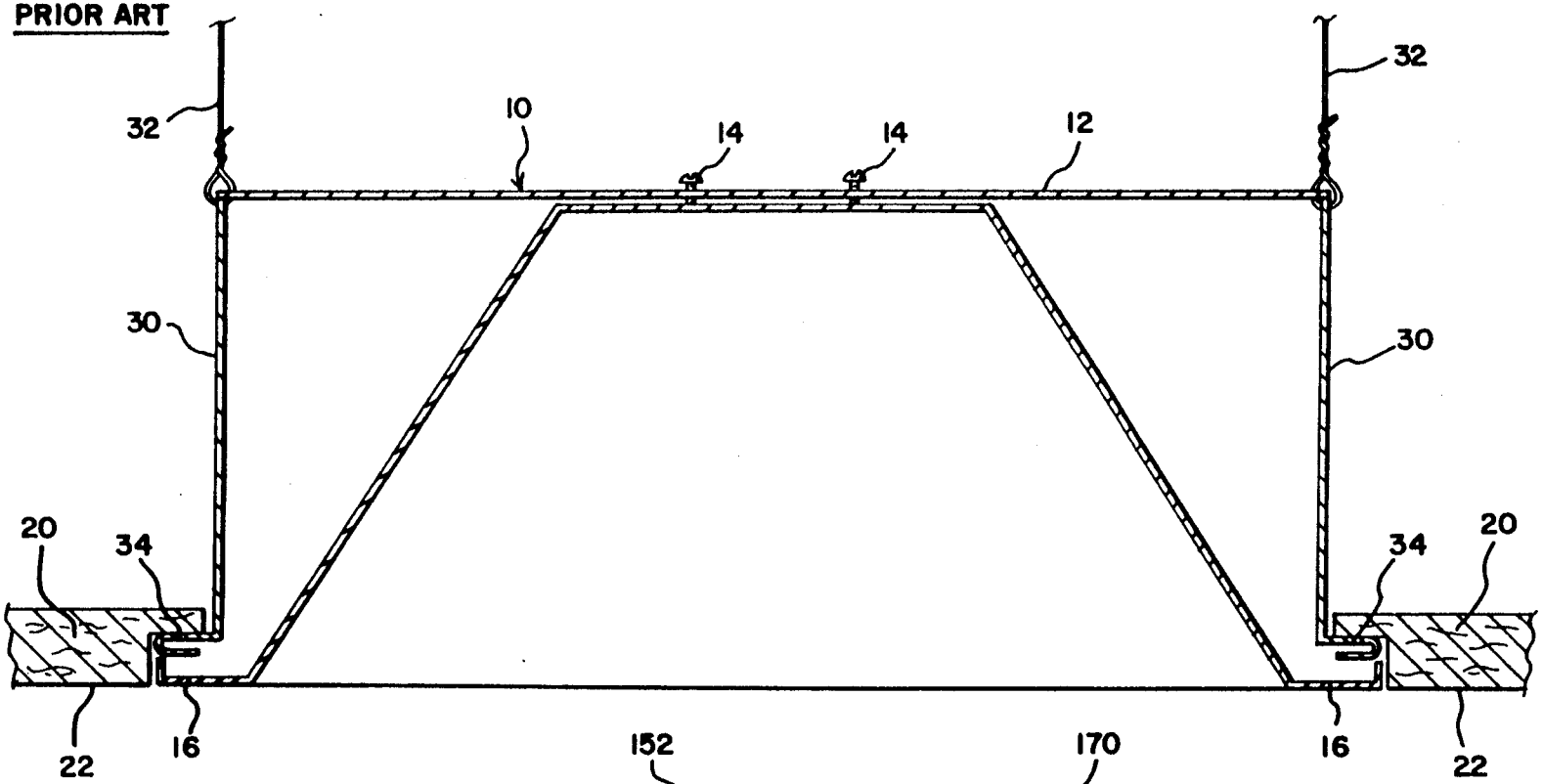
FIG. 1 PRIOR ART
FIG. 1 is a sectional view of a prior art suspended ceiling system having light fixtures, ceiling panels and supports.

While this invention is susceptible of embodiments in many different forms, there is shown in the drawings and will herein be described in detail, several preferred embodiments of the invention with the understanding that the present disclosure is to be considered as an exemplification of the principles of the invention and is not intended to limit the broad aspects of the invention to the embodiments illustrated.

FIG. 1 shows a typical commercial suspended ceiling system having light fixtures 10 and ceiling panels 20. A pair of supports 30 such as angle iron are used to mount the light fixture 10 and ceiling panels 20. Supports 30 can be directly anchored to a ceiling slab (not shown) or suspended form support wires 32. Each light fixture 10 is provided with a lug 12 that rests on the top of its respective supports 30. Supports 30 are L-shaped and form a ledge 34 for mounting ceiling panels 20. The light fixture lugs 12 are provided with screws 14 for adjusting the height of the fixtures. Screws 14 allow a bottom surface 22 of ceiling panels 20 to be adjusted flush with a lower lip 16 of light fixtures 10. Light fixtures 10 are typically arranged in parallel rows as in FIG. 7. This parallel arrangement allows several light fixtures 10 to be supported by a common pair of supports 30 running along parallel edges 18 of fixture 10.

Figure 2:
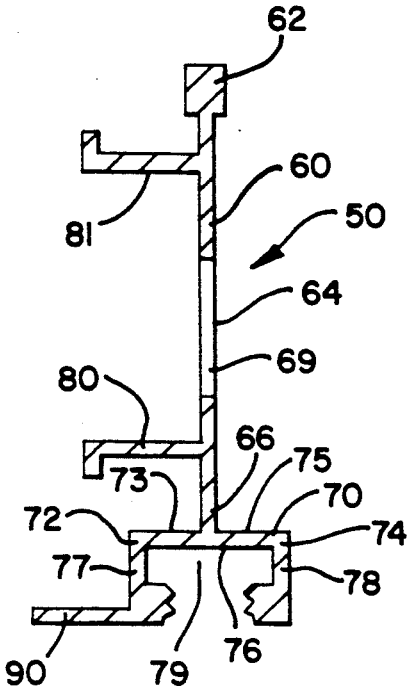
FIG. 2 is a sectional view of a single flange bracket.
Figure 3:
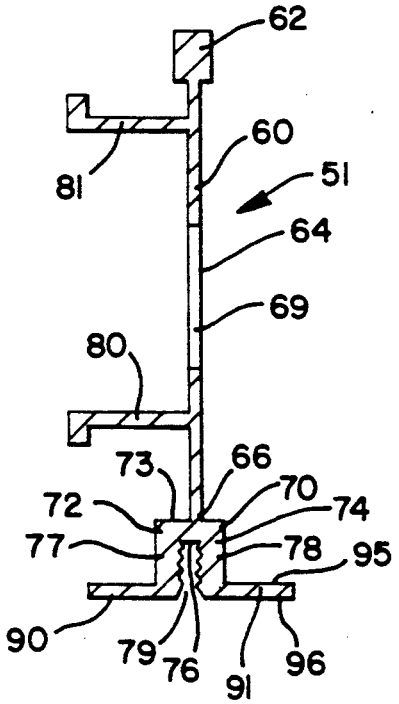
FIG. 3 is a sectional view of a double flange bracket.

The present inventive method of installing asbestos impermeable acoustic ceiling panels utilizes brackets 50 or 51 shown generally in FIGS. 2 or 3 respectively. Brackets 50 or 51 are preferably long metal extrusions formed through an economical single extrusion process. Each bracket 50 or 51 comprises a base portion 60, a tee portion 70, a pair of legs 80 and 81, and at least one flange. Bracket 50 has a single flange 90. Bracket 51 has a pair of flanges 90 and 91.

Base 60 preferably has a top end 62 a middle 64, a bottom end 66, and inside 67 and outside 68 surfaces. The middle 64 is preferably notched 69 for attaching a cross tee 100 or 101 as will be discussed later.

Tee 70 preferably has an inside end 72, a middle 73, an outside end 74, and upper 75 and lower 76 surfaces. The middle 73 of tee 70 is preferably perpendicularly and integrally attached to base bottom end 66. Preferably, both the inside and outside ends 72 and 74 have downwardly projecting portions 77 and 78 that define a slot 79 along the lower surface 76.

Legs 80 and 81 are of predetermined length and project from base 60. Each leg has one end 82 that is preferably perpendicularly and integrally attached to inside surface 67 of base 60. The other end 94 of legs 80 and 81 is free. One leg 81 is preferably attached below notch 69 and near base bottom end 66. A second leg 81 is preferably attached above notch 69 and near the base top end 62. Although FIGS. 2 and 3 show brackets 50 and 51 with a pair of legs 80 and 81, it should be understood that only one leg or three or more legs could be provided.

Flanges 90 and 91 are also of predetermined length and project from tee 70. Flange 90 is perpendicularly attached to tee inside projection 77 for both brackets 50 and 51. Flange 91 is perpendicularly attached to tee outside projection 78. Flanges 90 and 91 project opposite each other and are preferably parallel to tee 70 and legs 80 and 81.

Figure 4:
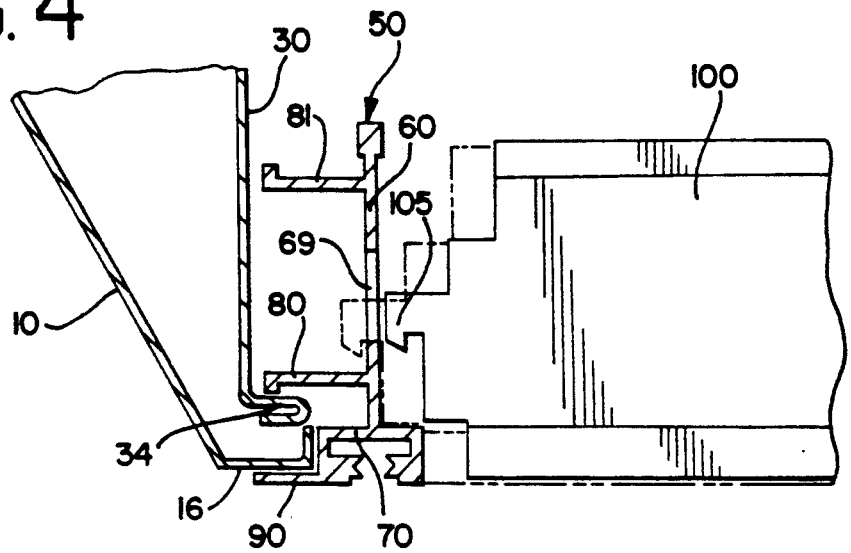
FIG. 4 is a sectional view of FIG. 2 showing a light fixture, a support, a single flange bracket and a cross tee.
Figure 5:
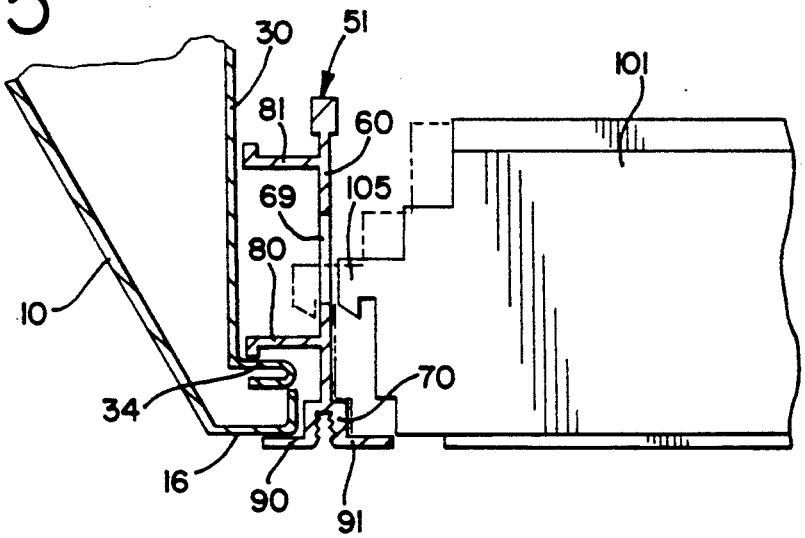
FIG. 5 is a sectional view of FIG. 2 showing the light fixture, support, a double flange bracket and a cross tee.

As shown in FIGS. 4 and 5, either bracket 50 or 51 is aligned to run along the parallel edges 18 of the existing light fixtures 10. The upper surface of flange 80 engages and covers all or a portion of light fixture lip 16. Flange 80 and lower leg 90 are preferably spaced apart a predetermined distance to snugly accommodate light fixture lip 16 and support ledge 34. Lower leg 90 preferably rests on support ledge 34.

The free end 94 of leg 91 is then attached to support 30 by any conventional means such as by a mechanical fastener. Leg 90 need not be integrally attached to support 30 as it is difficult to access and is preferably resting on support ledge 34. Brackets 50 or 51 are attached to each of the existing supports 30 running along the parallel edges 18 of existing light fixtures 10. Although support 30 is shown to be L-shaped, it should be understood that support 30 could be U-shaped or have an additional H, Z or T member attached thereto.

Figure 6:
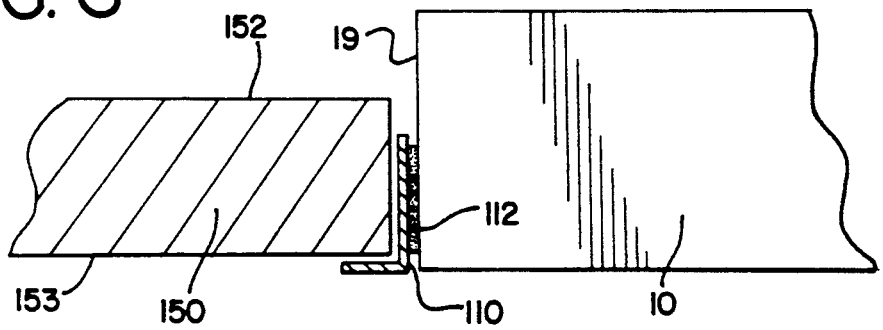
FIG. 6 is a sectional view of FIG. 2 showing an angle attached to a lateral side of a light fixture and supporting an acoustical ceiling panel.

Cross tees 100 or 101 and angles 110 are preferably provided for additional support of the ceiling panels. The ends of cross tees 100 or 101 are adapted to engage the outside surface 68 of brackets 50 or 51, and are provided with a hook 105 for securing to bracket notch 69. Angles or "T's" 110 are attached to the lateral ends 19 of existing light fixtures 10 as shown in FIG. 6. This is preferably done using double-sided tape 112.

Figure 7:
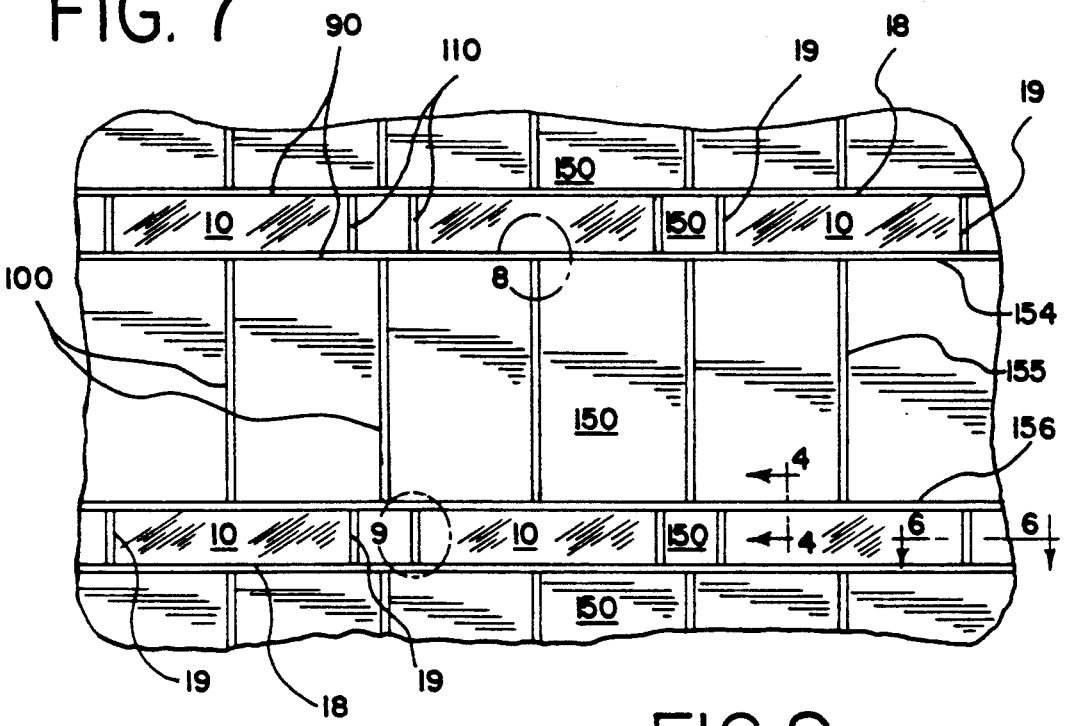
FIG. 7 is a bottom view of a ceiling system having parallel rows of light fixtures with new ceiling panels installed.
Figure 8:
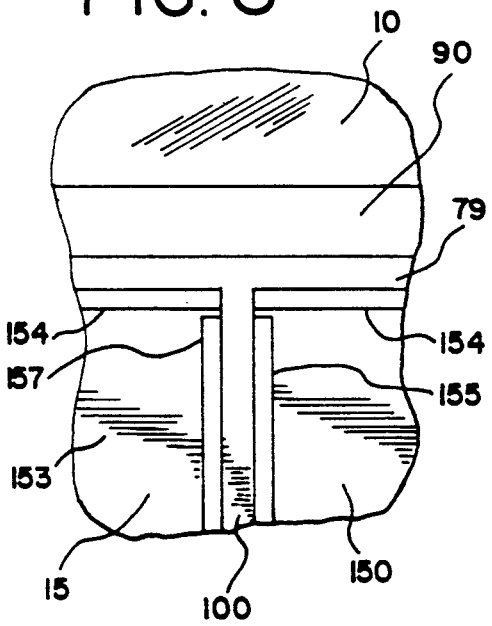
FIG. 8 is an enlarged view of FIG. 2 showing a light fixture, a bracket, a cross tee, and a ceiling panel.
Figure 9:
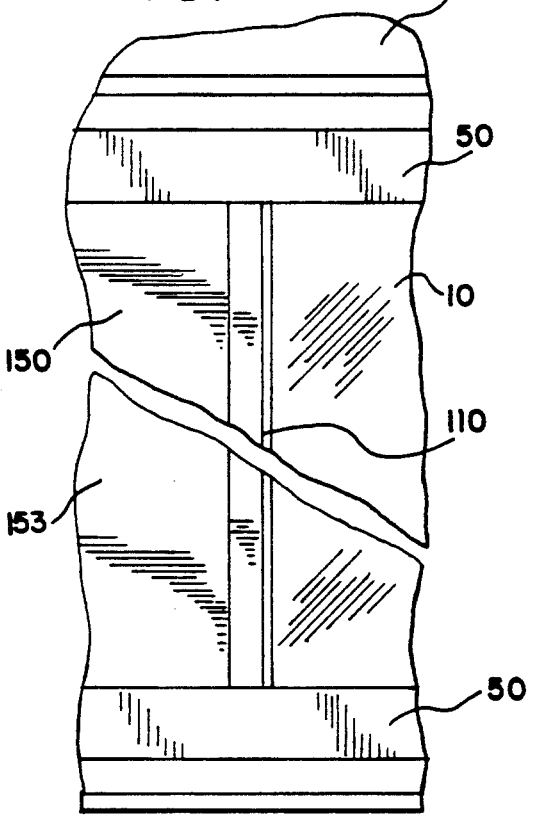
FIG. 9 is an enlarged view of FIG. 2 showing a light fixture, an angle, two brackets, and a ceiling panel.

New ceiling panels 150, which are preferably asbestos impermeable, acoustic ceiling panels, are now mounted on the newly installed suspended ceiling grid, as shown in FIGS. 7, 8 and 9. This grid preferably comprises brackets 50 or 51, cross tees 100 or 101, and angles 110. The ceiling panel 150 has upper 152 and lower 153 surfaces, and edges 154, 155, 156 and 157 that define the outer margins of the panel. FIG. 7 generally shows ceiling panels 150 mounted between existing light fixtures 10 arranged in parallel rows. The panels 150 are mounted on a ceiling grid comprised of brackets 50, cross tees 100 and angles 110.

When single flange brackets 50 are used, the lower of the edges 154 and 156 of panel 150 are preferably routed. This enables the panels 150 to rest on the upper surface 78 of bracket tee 70 while the lower panel surface 153 remains flush with light fixture lip 16. Edges 155 and 157 should also be routed to rest on cross tee 100.

When double flange brackets 51 are used, the edges of the panels 150 rest directly on the upper surface 95 of flange 91. Flange 91 permits panels 150 to adjustably fit into the ceiling grid. The length and width of the panel can vary during manufacture without risk of gaps forming between the panel 150 and the bracket flanges 91 after installation.

Figure 10:
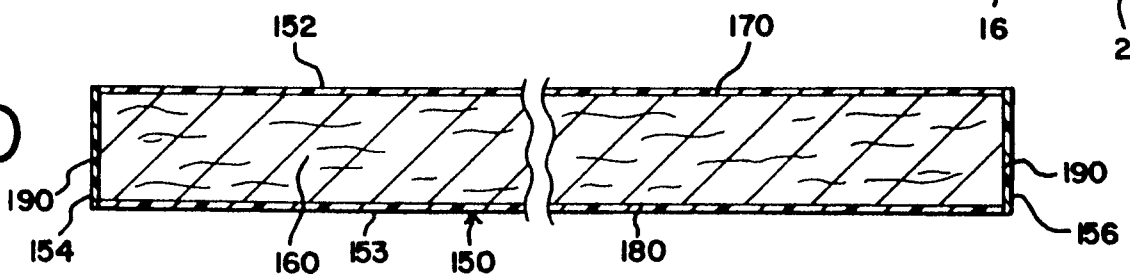
FIG. 10 is a plan view of an asbestos impermeable, acoustical ceiling panel.

Asbestos impermeable, acoustic ceiling panel 150 is shown in FIG. 10. Ceiling panel 150 generally comprises an acoustical layer 160, an upper asbestos impermeable layer 170, a lower decorative layer 180, and an asbestos impermeable coating 190 applied to the edges of the panel. Although the acoustical layer 160 is shown as a single layer, it should be understood that it could comprise multiple layers such as glass fiber and gypsum or mineral board. In this way, ceiling panel 150 can be modified to meet the specific acoustical Sound Transmission and Noise Reduction characteristics needed for a given ceiling system. Upper layer 170 is preferably a vinyl layer such as a clean room vinyl finish typically found on the lower surface of computer room ceiling panels. Decorative coating 180 is also asbestos impermeable, and asbestos impermeable coating 190 is preferably a coating of paint.

Asbestos particles that fall from the ceiling slab will not contaminate panels 150 or pass through the panel and into the work areas of a building. Instead, asbestos particles will accumulate on the upper surface 152. These particles can be easily removed by vacuuming the upper surface of the panel.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What we claim is:

1. A method of installing ceiling panels to an existing suspended ceiling system by utilizing existing light fixture supports having a ledge and light fixtures having a lip, the method comprising the following steps:

providing a plurality of brackets, each bracket having a base portion, a tee portion, a leg extending from said base portion, and a flange extending from said tee portion in substantially the same direction as said leg, said leg and flange being spaced a predetermined distance;

aligning said bracket flanges to engage the lips of the existing light fixtures;

attaching said bracket legs to the existing light fixture supports; and mounting ceiling panels on said tee portions of said brackets.

2. The method of claim 1, wherein said light fixtures are aligned in spaced parallel rows and said ceiling panels are mounted between said spaced parallel rows.

3. The method of claim 1, wherein the existing light support ledge and light fixture lip fit between said flange and said leg of said bracket.

4. The method of claim 1, wherein said brackets have a second flange for adjustably mounting said ceiling panels, said second flange extending from said tee portion substantially opposite and parallel to said first flange.

5. The method of claim 1, wherein each of said brackets has a pair of legs.

6. The method of claim 1, further comprising the step of attaching cross tees to and between said brackets and attaching angles to the lateral edges of the light fixtures.

7. The method of claim 1, wherein the new ceiling panel is impermeable to asbestos.

8. The method of claim 7, wherein the ceiling panel comprises:

a layer of acoustical material such as fiber glass, said acoustical layer having upper and lower surfaces and edges that define the outer margins of said acoustical layer; a vinyl backing secured to said upper surface of said acoustical layer, and an asbestos impermeable coating applied to said edges of said acoustical layer.

9. In combination with an existing light fixture support having a lip and a light fixture support having a ledge bracket for mounting ceiling panels supports without removing and any asbestos insulation, said bracket comprising:

a base portion;

a tee portion attached to said base, said tee for mounting the ceiling panel;

a first leg extending from said base portion, said leg for attaching the bracket to the existing light fixture support;

a first flange extending from said tee portion in substantially the same direction as said first leg, said first flange being spaced a predetermined distance from said first leg, said first flange engaging the lip of the existing light fixture.

10. The bracket of claim 9, further comprising a second leg extending from said base for attaching the bracket to the light fixture support, said second leg extending from said bracket base in substantially the same direction as said first leg.

11. The bracket of claim 9, further comprising a second flange extending from said tee for adjustably mounting the ceiling panel, said second flange extending substantially opposite and parallel to said first flange.

12. The bracket of claim 9, wherein said tee is provided with first and second downwardly projecting portions, said first and second flanges being attached to said first and second downwardly projecting portions respectively, said second downwardly projecting portion engaging the ceiling panel.

* * * * *